US007047781B1

(12) United States Patent
Kanemitsu et al.

(10) Patent No.: US 7,047,781 B1
(45) **Date of Patent: *May 23, 2006**

(54) SHEET METAL MEMBER HAVING AN ANNULAR PERIPHERAL WALL AND A METHOD OF THICKENING AN ANNULAR PERIPHERAL WALL OF THE SHEET METAL MEMBER

(75) Inventors: Toshiaki Kanemitsu, Kobe (JP); Shuji Kanemitsu, Kakogawa (JP); Hironori Nishioka, Kobe (JP)

(73) Assignee: Kabushiki Kaisha Kanemitsu, Akash (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/669,313

(22) PCT Filed: Jan. 27, 1995

(86) PCT No.: PCT/JP95/00110

§ 371 (c)(1),
(2), (4) Date: Jul. 8, 1996

(87) PCT Pub. No.: WO96/22847

PCT Pub. Date: Aug. 1, 1996

(51) Int. Cl.
*B21H 1/04* (2006.01)

(52) U.S. Cl. ..... 72/110
(58) Field of Classification Search ..... 72/68, 72/110, 111; 29/892, 892.3, 893.32
See application file for complete search history.

(56) References Cited

U.S. PATENT DOCUMENTS 5,068,964 A * 12/1991 Yabuno et al. ..... 29/892.3
5,113,584 A * 5/1992 Wenzel ..... 29/892
5,237,745 A * 8/1993 Yamanaka ..... 72/68
5,396,787 A * 3/1995 Kanemitsu et al. ..... 72/111

FOREIGN PATENT DOCUMENTS

| | | | |
|---|---|---|---|
| GB | 2 045 665 | * 11/1980 | ..... 29/893.32 |
| JP | 39-20940 | 9/1964 | |
| JP | 58-54898 | 12/1983 | |
| JP | 59-209435 | 11/1984 | |
| JP | 63-60269 | 11/1988 | |
| JP | 1-150070 | 6/1989 | |
| JP | 2-29413 | 6/1990 | |

* cited by examiner

*Primary Examiner*—Lowell A. Larson
(74) *Attorney, Agent, or Firm*—Bacon & Thomas

(57) ABSTRACT

The present invention relates to a sheet metal member having an annular peripheral wall and a method of thickening an annular peripheral wall of the sheet metal member. The thickness of the annular peripheral wall is increased to be 2 or more times or 3 or more times that of a base plate. Teeth for a timing toothed belt, a gear, or the like are cut in the annular peripheral wall which is thickened in this way. In the method of thickening an annular peripheral wall of the present invention, a base plate integrally having a flange-shaped portion is held between a circular bottom pattern tool and a circular top pattern tool, the flange-shaped portion which projects outwardly and the circular top pattern tool is sequentially pressed in a radially inward direction by annular forming faces of circular rollers of plural kinds, thereby thickening the flange-shaped portion. The flange-shaped portion is then formed into a cylindrical shape which is concentric with the base plate. According to the method, it is not required to separately produce the peripheral wall and the base plate and then weld them together. The peripheral wall can be provided with the strength required for cutting teeth in the peripheral wall.

1 Claim, 7 Drawing Sheets

SHEET METAL MEMBER HAVING AN ANNULAR PERIPHERAL WALL AND A METHOD OF THICKENING AN ANNULAR PERIPHERAL WALL OF THE SHEET METAL MEMBER

TECHNICAL FIELD

The present invention relates to a sheet metal member having an annular peripheral wall, such as a drive plate, and also to a method of thickening an annular peripheral wall of the sheet metal member, and particularly to a technique wherein a disk-shaped sheet metal member having a small thickness is used and an annular peripheral wall having a thickness which is several times the thickness of the sheet metal member. The thickened annular peripheral wall of the invention is suitable for cutting teeth to be engaged with a timing toothed belt, a gear, or the like. Teeth which are cut in this way have sufficient strength and thickness, and are suitable particularly for use as an automobile part.

BACKGROUND ART

In a drive plate used in a starter for starting an engine of an automobile, teeth are formed on a peripheral wall disposed in the outer peripheral portion of a disc-like base plate. FIG. 15 is a section view diagrammatically showing a prior art drive plate. As shown in the figure, in the prior art drive plate, a cylindrical portion 2 which is formed by drawing so that it is substantially equal in thickness to a base plate 1 is integrated with the outer peripheral portion of the base plate 1, a cylindrical peripheral wall member 4 wherein teeth 3 are cut in the outer periphery is fitted into the cylindrical portion 2. The peripheral wall member 4 is joined to the cylindrical portion 2 by welding 5.

Even when the peripheral wall member 4 itself has a strength and thickness sufficient for cutting the teeth 3, however, such a drive plate has problems such as defects due to welding failures which are easily produced, requiring an expensive automatic welding robot.

It is an object of the present invention to provide a sheet metal member and a method of thickening an annular peripheral wall of the sheet metal member in which, in a member wherein an annular peripheral wall is formed on a base plate as seen in a drive plate, the base plate and the annular peripheral wall are integrated with each other and teeth can be directly cut in the annular peripheral wall without causing the member to have insufficient strength.

SUMMARY OF THE INVENTION

In order to attain the above-mentioned object, in the sheet metal member of the present invention, a base plate and an annular peripheral wall which extends in a perpendicular direction from the outer periphery of the base plate are integrally formed, and the thickness of the annular peripheral wall is increased to be 2 or more times or 3 or more times the thickness of the base plate.

As a result of the success of the thickening method which will be described later, in the sheet metal member of the present invention, the annular peripheral wall is thickened by a factor of 2 or more, or 3 or more which is unexpected in the prior art. Therefore, teeth, which are cut in a peripheral wall member of a drive plate of the prior art, can be directly cut in the outer face of the annular peripheral wall. Consequently, it is possible to eliminate two steps which are performed on the drive plate of the prior art, i.e., the steps of fitting the peripheral wall member 4 wherein the teeth 3 are cut, into the cylindrical portion 2 of the sheet metal member, and welding the peripheral wall member 4 to the cylindrical portion 2. Furthermore, since the base plate uses a sheet metal member which is thinner than the annular peripheral wall or has a smaller thickness, the weight and the material cost are prevented from being increased.

The method of thickening the annular peripheral wall 2 or more times or 3 or more times comprises the steps of: holding a base plate of a disc member having the base plate and a flange-shaped portion integrally formed in the outer periphery of the base plate, between a circular bottom pattern tool and a circular top pattern tool; sequentially pressing the flange-shaped portion projected outside the circular bottom pattern tool and the circular top pattern tool, in a radially inward direction by recessed annular forming faces of circular rollers of plural kinds each having a recessed annular forming face, thereby sequentially thickening the rear side of the flange-shaped portion; and forming the thickened flange-shaped portion into a cylindrical shape which is concentric with the base plate, to form a thickened annular peripheral wall, thereby attaining the thickening in which the thickness of the annular peripheral wall of the sheet metal member is 2 or more times or 3 or more times that of the base plate.

DETAILED DESCRIPTION OF A PREFERRED EMBODIMENTS OF THE PRESENT INVENTION

Figure 1:
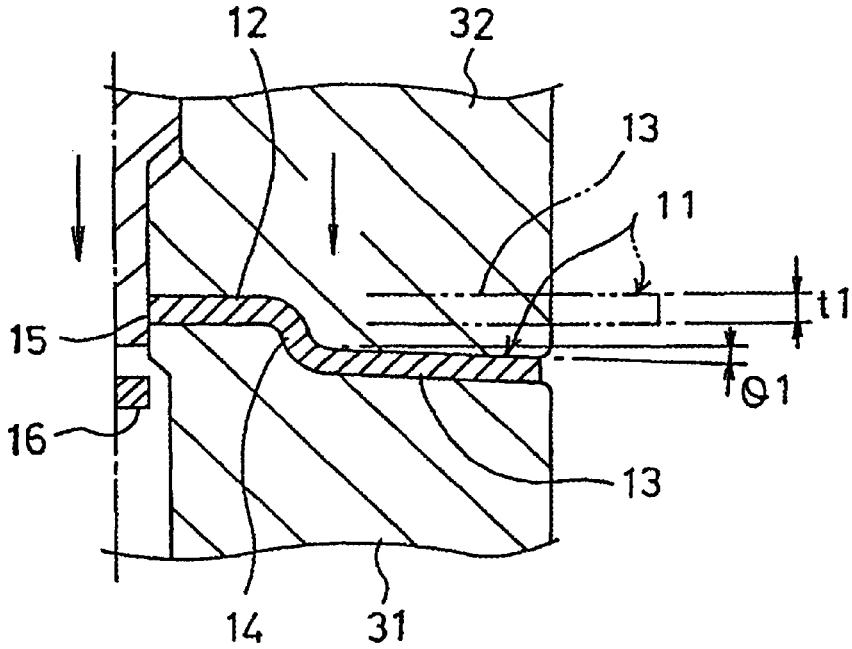
FIG. 1 is a view illustrating a step of drawing a circular sheet metal member.

FIGS. 1 to 6 show an embodiment wherein a drive plate which is to be used in a starter for starting an engine of an automobile is produced by applying the method of thickening an annular peripheral wall according to the present invention to a thin disc member which is made of a steel plate and serves as a sheet metal member. A disc member 11 used as a starting material has a thickness t1 of 2 mm. The method of thickening an annular peripheral wall according to the present invention is applied to the disc member 11. The disc member 11 comprises a base plate 12 and a flange-shaped portion 13 which is integrated to the outer side of the base plate 12. The flange-shaped portion 13 may be continuous with the base plate 12 in a flat manner or continuous with the base plate via a stepped portion. In the embodiment, as shown in FIG. 1, the flat disc member 11 which is placed on a lower pattern tool 31 is pressed by an upper pattern tool 32, thereby drawing the disc member 11. The disc member 11 formed in this way, i.e., the disc member 11 comprising the base plate 12 and the flange-shaped portion 13 which is formed on the base plate 12 via a stepped portion 14 is used.

In the drawing step of FIG. 1, the flange-shaped portion 13 is inclined slightly downward when moving outward. In the figure, the angle formed by the flange-shaped portion 13 and the base plate 12 is indicated by a reference symbol θ1. For example, the inclination angle θ1 is 5 deg. At the same time with the drawing step of FIG. 1, the center of the base plate 12 is punched by a piercing process so that a circular hole 15 is opened. The reference numeral 16 designates waste produced in the piercing process.

FIGS. 2 to 5 show stages of a step in which the disc member 11 is held between a circular bottom pattern tool 33 and a circular top pattern tool 34 and the flange-shaped portion 13 is gradually thickened by using circular rollers 35 to 38 of several configurations.

Figure 2:
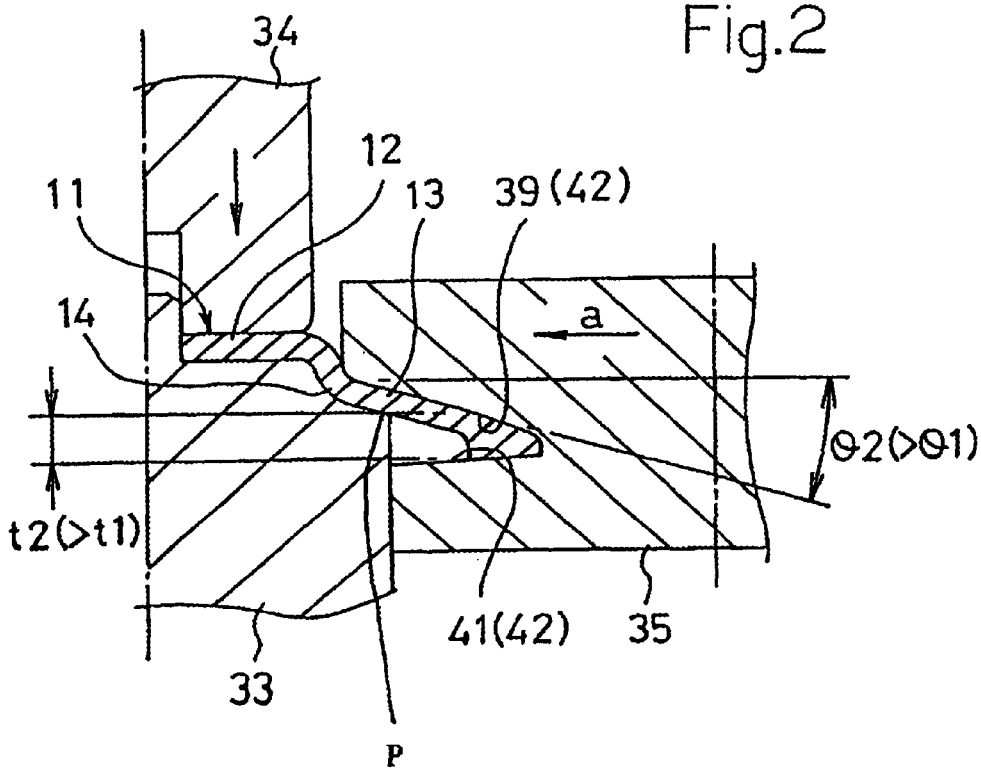
FIG. 2 is a view illustrating an initial stage of gradually thickening the flange-shaped portion which is formed in the drawing step.

The circular roller 35 used in the step of FIG. 2 has a recessed annular forming face 42 comprising an upper receiving face 39 which is inclined by an inclination angle θ2 upward when moving outward, and a lower receiving face 41 which is slightly inclined downward when moving outward. While the circular bottom pattern tool 33, the circular top pattern tool 34, and the flange-shaped portion 13, which projects outwardly from the circular top pattern tool 34, are rotated, the outer peripheral portion of the flange-shaped portion 13 is pressed in a radially inward direction by the annular forming face 42 of the circular roller 35 which is horizontally moved in a direction of the arrow a in FIG. 2, so that the outer peripheral portion of the flange-shaped portion 13 has a section of a substantially triangular shape. Specifically, in the stage of FIG. 2, the flange-shaped portion 13 is pushed downward by the upper receiving face 39 of the forming face 42, so as to be inclined to the inclination angle θ2 with respect to the base plate 12. The inclination angle θ2 is larger than the inclination angle θ1 shown in FIG. 1. For example, the inclination angle θ2 is 21 deg. In this stage, the outer peripheral portion of the flange-shaped portion 13 is caused to be projected toward the rear side (in other words, the material plastically flows toward the rear side) by the annular forming face 42 which is narrowed as moving inward, so as to be thickened to a thickness of t2 (t2>t1).

Figure 3:
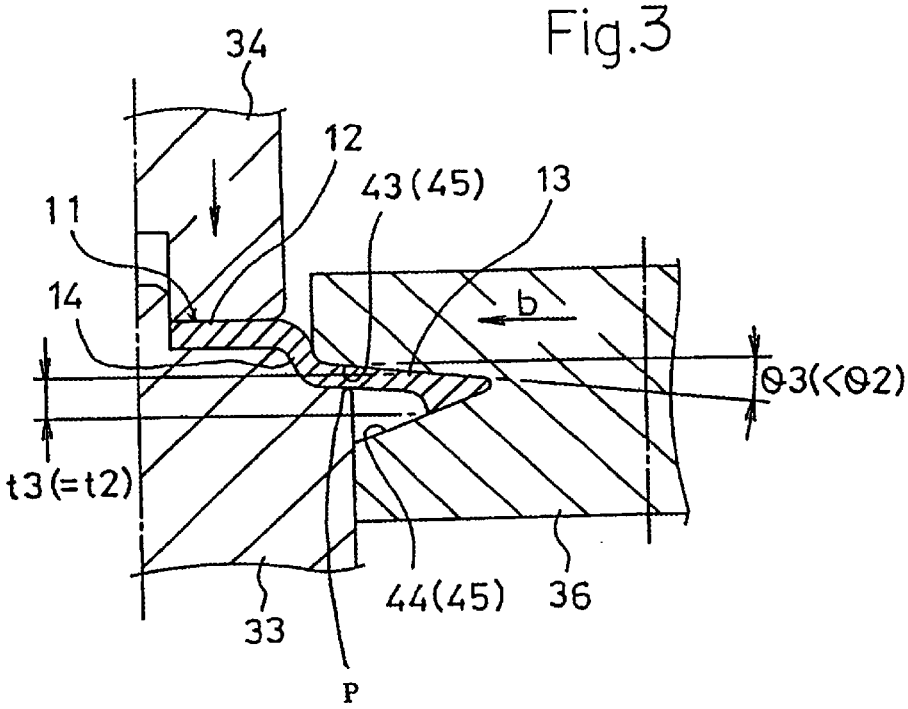
FIG. 3 is a view illustrating an intermediate stage of the step of gradually thickening the flange-shaped portion.

The circular roller 36 used in the step of FIG. 3 has a recessed annular forming face 45 comprising an upper receiving face 43 which is inclined by an inclination angle θ3 upward as moving outward, and a lower receiving face 44 which is inclined downward as moving outward. While the flange-shaped portion 13 in which the outer peripheral portion is thickened as a result of conducting the stage of FIG. 2 is rotated by the pattern tools 33, 34, the outer peripheral portion of the flange-shaped portion 13 is pressed in a radially inward direction by the annular forming face 45 of the circular roller 36 which is horizontally moved in a direction of an arrow b in FIG. 3, so that the outer peripheral portion of the flange-shaped portion 13 has a section of a substantially triangular shape. Specifically, in the stage o FIG. 3, the lower face of the outer peripheral portion of the flange-shaped portion 13 is pushed upward by the lower receiving face 44 of the forming face 45, so that the flange-shaped portion 13 is inclined to the inclination angle θ3 with respect to the base plate 12. The inclination angle θ3 is smaller than the inclination angle θ2 shown in FIG. 2. For example, the inclination angle θ3 is 5 deg. In this stage, only the process of changing the inclination angle θ2 of the flange-shaped portion 13 to the inclination angle θ3 is performed and the thickening of the flange-shaped portion 13 is not substantially performed. Therefore, the thickness t3 of the outer peripheral portion of the flange-shaped portion 13 is not substantially changed from that in the stage of FIG. 2 (t3=t2).

Figure 4:
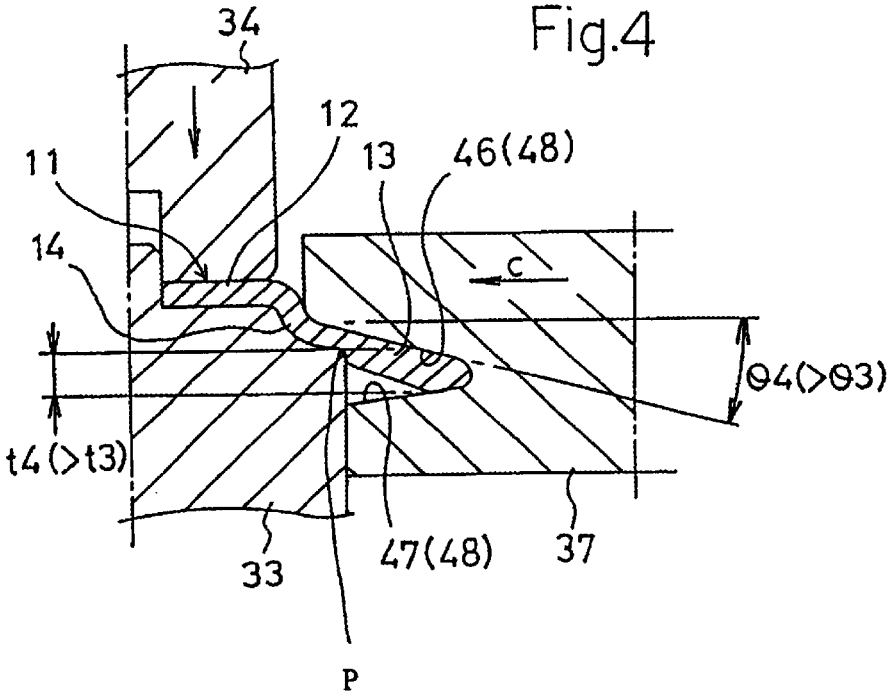
FIG. 4 is a view illustrating another intermediate stage of the step of gradually thickening the flange-shaped portion.

The circular roller 37 used in the step of FIG. 4 has a recessed annular forming face 48 comprising an upper receiving face 46 which is inclined by an inclination angle θ4 upward when moving outward, and a lower receiving face 47 which is inclined downward when moving outward. While the flange-shaped portion 13 which has the inclination angle θ3 as a result of performing the stage of FIG. 3 is rotated by the pattern tools 33, 34, the flange-shaped portion 13 is pressed in a radially inward direction by the annular forming face 48 of the circular roller 37 which is horizontally moved in a direction of an arrow c in FIG. 4, so that the flange-shaped portion 13 has a section of a substantially rectangular shape. Specifically, in the stage of FIG. 4, the flange-shape portion 13 is pushed downward by the upper receiving face 46 of the forming face 48, so that the flange-shaped portion 13 is inclined to the inclination angle θ4 with respect to the base plate 12. The inclination angle θ4 is larger than the inclination angle θ3 shown in in FIG. 3. For example, the inclination angle θ4 is 10 deg. In this stage, the outer peripheral portion of the flange-shaped portion 13, which has been thickened, is caused to be further projected in the rear side (in other words, the material plastically flows toward the rear side) by the annular forming face 48 which is narrowed as moving inward, so as to be thickened to a thickness of t4 (t4>t3).

Figure 5:
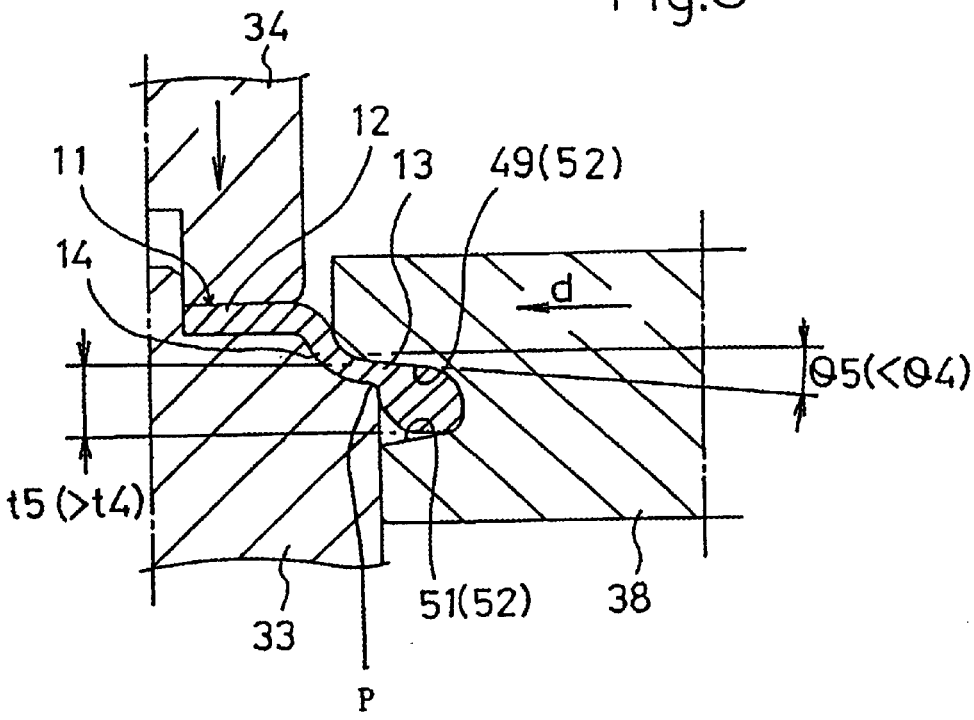
FIG. 5 is a view illustrating the final stage of the step of gradually thickening the flange-shaped portion.

The circular roller 38 used in the step of FIG. 5 has a recessed annular forming face 52 comprising an upper receiving face 49 which is inclined by an inclination angle θ5 upward when moving outward, and a lower receiving face 51 which is slightly inclined downward when moving outward. While the flange-shaped portion 13 which has the inclination angle θ4 as a result of conducting the stage of FIG. 4 is rotated by the pattern tools 33, 34, the flange-shaped portion 13 is pressed in a radially inward direction by the annular forming face 52 of the circular roller 38 which is horizontally moved in a direction of an arrow d in FIG. 5, so that the flange-shaped portion 13 has a section of a substantially rectangular shape. Specifically, in the stage of FIG. 5, the lower face of the outer peripheral portion of the flange-shaped portion 13 is pushed upward by the lower receiving face 51 of the forming face 52, so that the flange-shaped portion 13 is inclined to the inclination angle θ5 with respect to the base plate 12. The inclination angle θ5 is smaller than the inclination angle θ4 shown in FIG. 4. For example, the inclination angle θ4 is 5 deg. In this stage, the outer peripheral portion of the flange-shaped portion 13 which has been thickened to a considerably large degree is caused to be further projected in the rear side (in other words, the material plastically flows toward the rear side) by the annular forming face 52, so as to be further thickened. In the thickening of this stage, substantially whole portion of the projection of the flange-shaped portion 13 from the base plate is thickened so as to have a thickness of t5 (t5>t4). As a result, the flange-shaped portion is formed into a lump having a section of a substantially rectangular shape as shown in FIG. 5.

The flange-shaped portion 13 which is thickened by performing the stages described with reference to FIGS. 2 to 5 enters a state in which the portion is nearly formed into a peripheral wall. The thickness (the thickness in a radial direction) of the flange-shaped portion 13 (peripheral wall) can be made 3 or more times that of the base plate 12.

Figure 6:
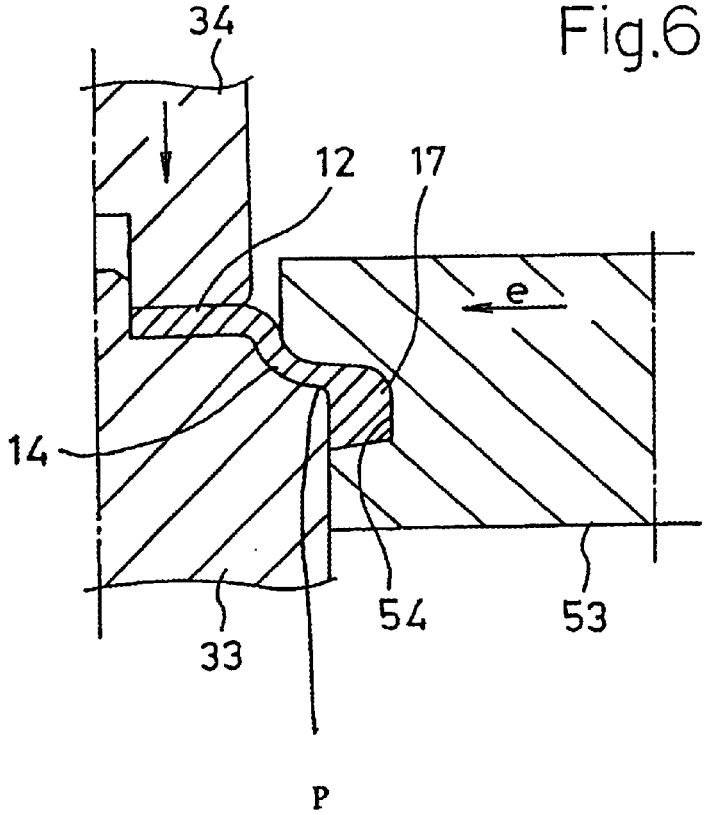
FIG. 6 is a view illustrating a step of forming an annular peripheral wall.

FIG. 6 shows the final stage of the stages described with reference to FIGS. 2 to 5, i.e., a step of, after the stage of FIG. 5, forming the thickened flange-shape portion 13 into a predetermined section shape. In this step, the flange-shaped portion 13 may be further thickened. Specifically, in this step, a circular roller 53 is used. The circular roller 53 comprises a recessed annular forming face 54 for forming the outer face of the peripheral wall. While the flange-shaped portion 13 which has passed through the stage of FIG. 5 is rotated by the pattern tools 33, 34, the flange-shaped portion is pressed in a radially inward direction by the annular forming face 54 of the circular roller 53 which is horizontally moved in a direction of the arrow e in FIG. 6, so that the flange-shaped portion 13 is formed into a cylindrical shape which is concentric with the base plate 12, with the result that an annular peripheral wall 17 having smooth outer and inner peripheral faces and having a section of a substantially square shape is formed.

In the embodiment described with reference to FIGS. 1 to 6, the thickened annular peripheral wall 17 which is eventually formed is about 7 mm, or it was possible to form the annular peripheral wall 17 having a thickness which is 3.5 times that of the base plate 12 (thickness of 2 mm). It is a matter of course that, when the preset conditions such as the angles of the annular forming faces 42, 45, 48, 52, 54 of the circular rollers 35 to 38, 53 are changed, the thickness of the annular peripheral wall 17 may be set to be 3.5 or less times (for example, 2 or 3 times) or 3.5 or more times hat of the base plate 12.

Figure 7:
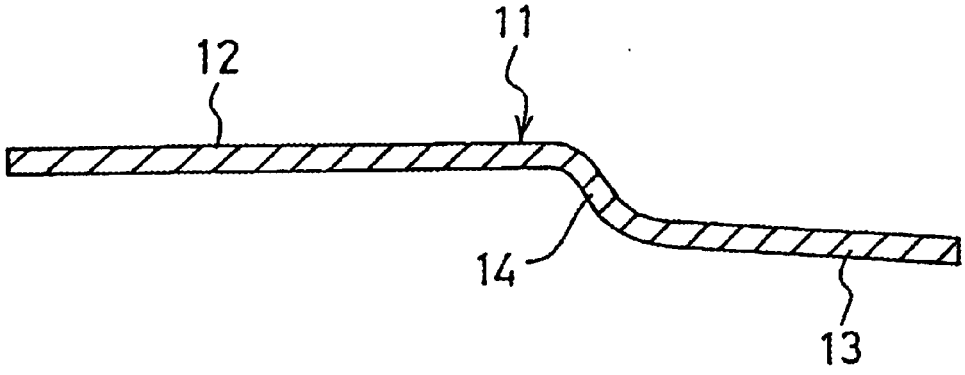
FIG. 7 is a partial end view showing the accurate shape of the member which is obtained by performing the drawing step of FIG. 1.
Figure 8:
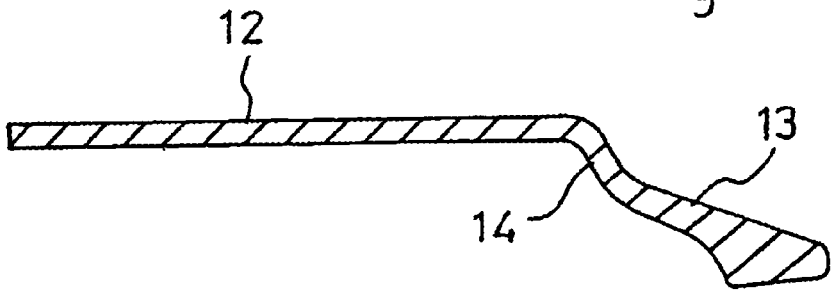
FIG. 8 is a partial end view showing the accurate shape of the member which is obtained by performing the stage of FIG. 2.
Figure 9:
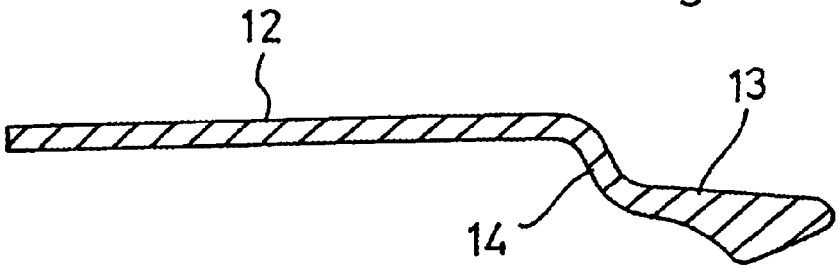
FIG. 9 is a partial end view showing the accurate shape of the member which is obtained by performing the stage of FIG. 3.
Figure 10:
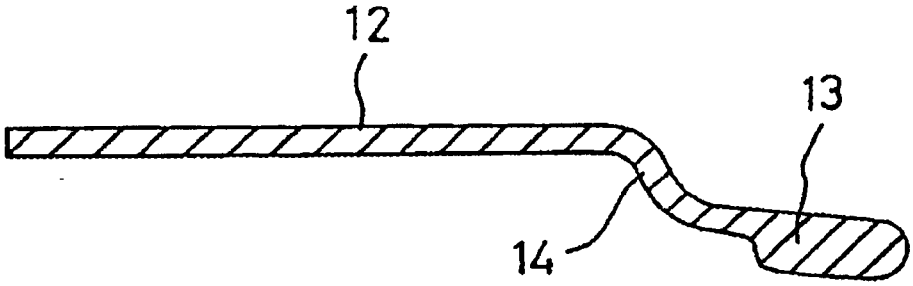
FIG. 10 is a partial end view showing the accurate shape of the member which is obtained by performing the stage of FIG. 4.
Figure 11:
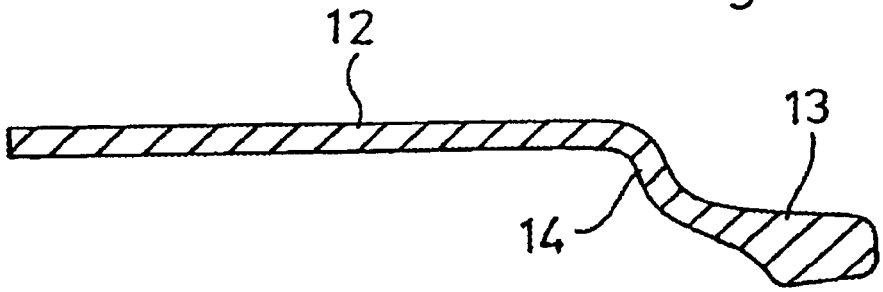
FIG. 11 is a partial end view showing the accurate shape of the member which is obtained by performing the stage of FIG. 5.
Figure 12:
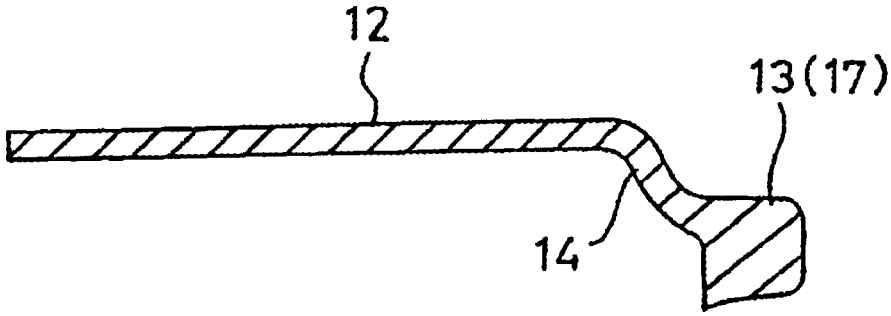
FIG. 12 is a partial end view showing the accurate shape of the member which is obtained by performing the stage of FIG. 6.

FIGS. 7 to 12 are partial end views showing the accurate shapes of the member which are obtained by performing the stages or steps described with reference to FIGS. 1 to 6. Specifically, FIG. 7 is a partial end view showing the accurate shape of the member which is obtained by performing the drawing step of FIG. 1, FIG. 8 is a partial end view showing the accurate shape of the member which is obtained by conducting the stage of FIG. 2, FIG. 9 is a partial end view showing the accurate shape of the member which is obtained by performing the stage of FIG. 3, FIG. 10 is a partial end view showing the accurate shape of the member which is obtained by conducting the stage of FIG. 4, FIG. 11 is a partial end view showing the accurate shape of the member which is obtained by performing the stage of FIG. 5, and FIG. 12 is a partial end view showing the accurate shape of the member which is obtained by performing the stage of FIG. 6. As seen also from these figures, the thickness of the flange-shaped portion 13 which can be substantially used as the annular peripheral wall 17 is 3 or more times that of the base plate 12, i.e., that of the disc member 11 which is a starting material.

Figure 13:
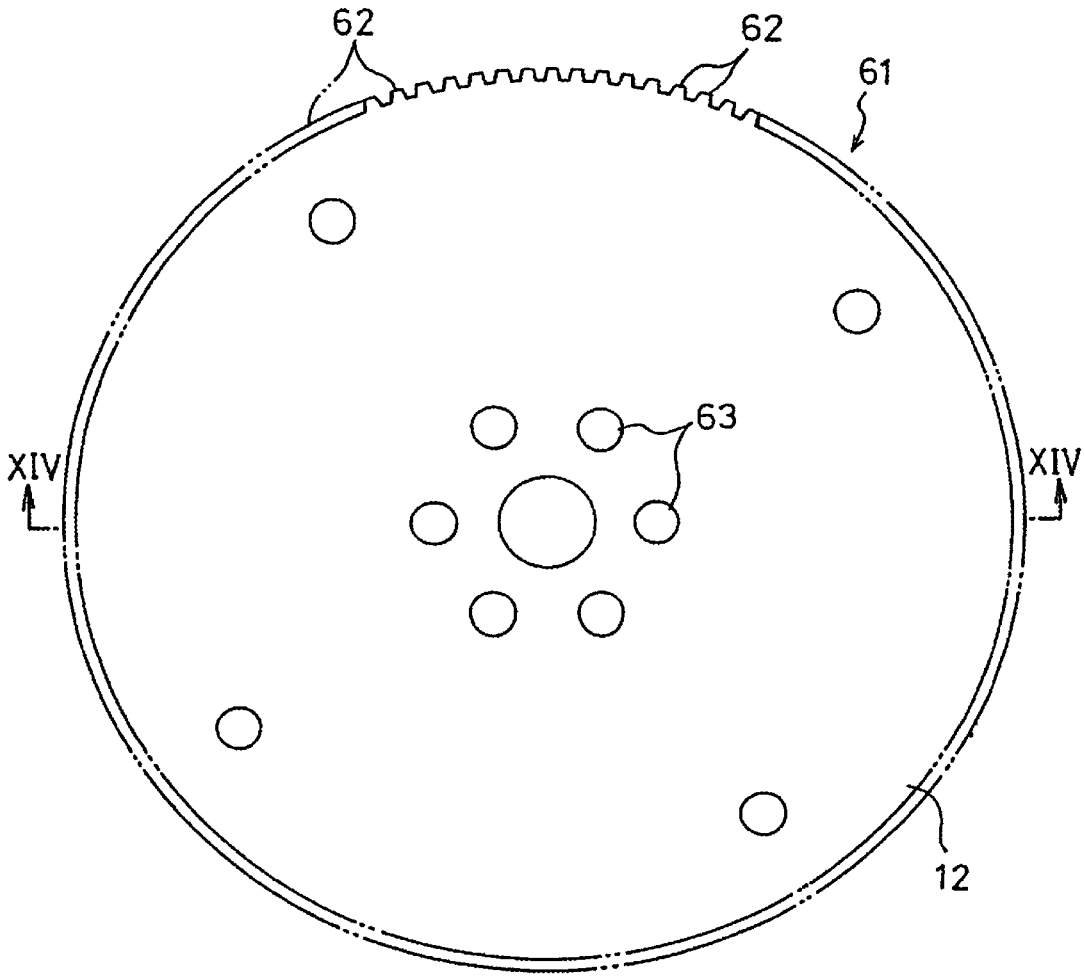
FIG. 13 is a front view of a drive plate which is an example of a sheet metal member having an annular peripheral wall according to an embodiment of the present invention.
Figure 14:
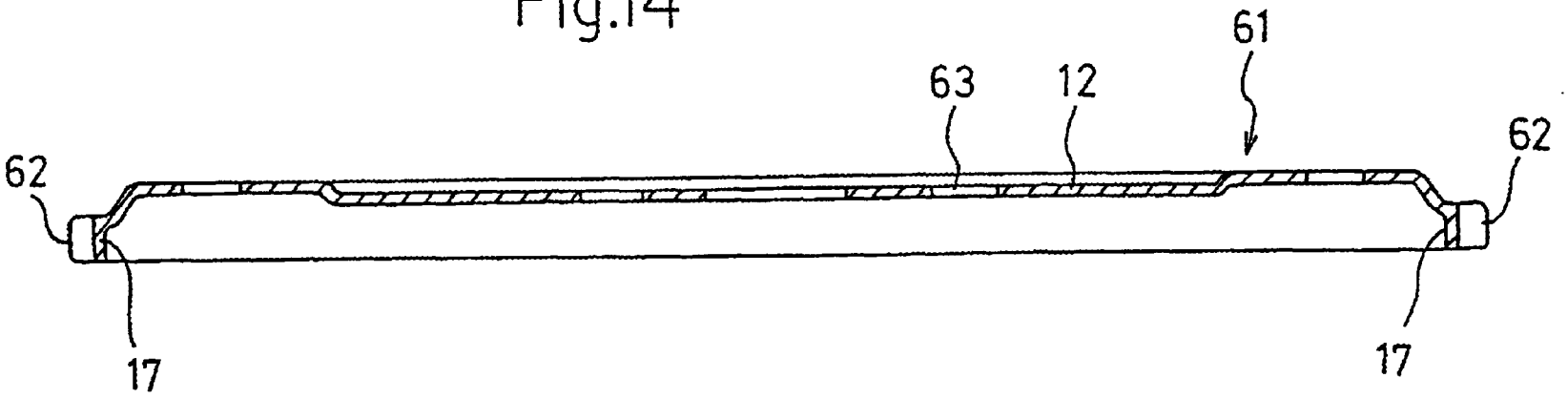
FIG. 14 is a section view taken along the line XIV—XIV of FIG. 13.
Figure 15:
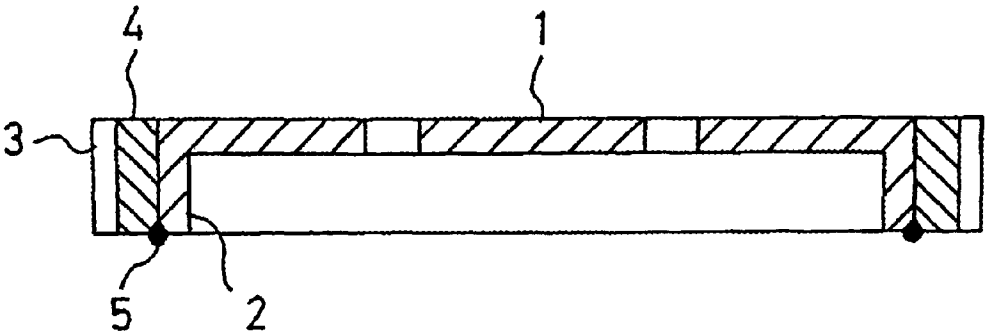
FIG. 15 is a section view diagrammatically showing a prior art drive plate.

FIG. 13 is a front view of a drive plate 61 which is an example of a sheet metal member having an annular peripheral wall, and which is used in a starter for starting an engine for an automobile, and FIG. 14 is a section view taken along the line XIV—XIV of FIG. 13. In the drive plate 61, the annular peripheral wall 17 integrated with the base plate 12 which extends in a perpendicular direction from the outer peripheral side of the annular peripheral wall 17 is thickened 2 or more times, preferably 3 or more times, more preferably 3.5 or more times, by the method described above, although depending on the thickness of the disc member 11 which is a starting material, and teeth 62 are cut in the outer peripheral face of the annular peripheral wall 17. There is no welding portion in the drive plate 61. As a result of the thickening of the annular peripheral wall 17, the wall is provided with a strength which allows the teeth 62 to be cut in the outer peripheral face. The reference numeral 63 designates mounting holes.

According to the sheet metal member having an annular peripheral wall, and the method of thickening an annular peripheral wall of the member of the present invention, an annular peripheral wall integrated with a base plate is thickened to a level which is 2 or more times or 3 or more times the thickness of the base plate. When teeth are cut in the outer peripheral face of the thickened annular peripheral wall, for example, a drive plate can be produced. In this case, a welding process is not required, and the weight and the material cost are prevented from being increased. Therefore, the invention is effective particularly in the case where a welding process is to be eliminated and the material cost is to be lowered.

What is claimed is:

1. A method of forming a thickened annular peripheral wall of a sheet metal member, comprising the steps of:

holding the sheet metal member and forming from the sheet metal member a base plate, a stepped portion and a flange-shaped portion connected integrally by the stepped portion with an outer periphery of the base plate; inserting the base plate, the stepped portion and at least a part of the flange-shaped portion between a circular bottom pattern tool and a circular top pattern tool; applying recessed annular forming faces of circular rollers of plural kinds against the flange-shaped portion and sequentially pressing the flange-shaped portion projecting outwardly from the circular bottom pattern tool and said circular top pattern tool in a radially inward direction, thereby sequentially thickening a rear side of the flange-shaped portion; and forming the thickened flange-shaped portion into a cylindrical shape which is concentric with the base plate, thereby forming the thickened annular peripheral wall;

wherein the flange-shaped portion is inclined relative to the base plate during the forming step; and wherein the inclination changes as the flange-shaped portion is sequentially pressed by the circular rollers.

* * * * *